US009688082B2

(12) United States Patent
Shinagawa et al.

(10) Patent No.: US 9,688,082 B2
(45) Date of Patent: Jun. 27, 2017

(54) RECORDING DEVICE AND CONTROL METHOD THEREFOR

(71) Applicant: Seiko Epson Corporation, Tokyo (JP)

(72) Inventors: Hiroki Shinagawa, Matsumoto (JP); Ryuji Moriyama, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/939,441

(22) Filed: Nov. 12, 2015

(65) Prior Publication Data

US 2016/0136973 A1 May 19, 2016

(30) Foreign Application Priority Data

Nov. 13, 2014 (JP) ..... 2014-230438

(51) Int. Cl.

| | |
|---|---|
| ***B41J 29/38*** | (2006.01) |
| ***B41J 23/00*** | (2006.01) |
| ***B41J 2/01*** | (2006.01) |
| ***B41J 11/00*** | (2006.01) |
| *B41J 19/20* | (2006.01) |

(52) U.S. Cl.

CPC ..... *B41J 11/006* (2013.01); *B41J 19/202* (2013.01)

(58) Field of Classification Search

CPC ..... B41J 11/006; B41J 19/202; B41J 29/38; B41J 2/04503; B41J 19/305; B41J 25/001

USPC ..... 347/14, 16, 37, 104

See application file for complete search history.

(56) References Cited

U.S. PATENT DOCUMENTS

| | | | | |
|---|---|---|---|---|
| 2006/0181556 | A1 | 8/2006 | Wanibuchi et al. | |
| 2009/0028586 | A1 | 1/2009 | Yamashiro et al. | |
| 2013/0076822 | A1* | 3/2013 | Ogimura | B41J 29/38 347/14 |

FOREIGN PATENT DOCUMENTS

| | | | |
|---|---|---|---|
| EP | 1 790 487 | A1 | 5/2007 |
| JP | 2004-009530 | A | 1/2004 |
| JP | 2005-112490 | A | 4/2005 |
| JP | 2006-021370 | A | 1/2006 |
| JP | 2006-225161 | A | 8/2006 |
| JP | 2007-144633 | A | 6/2007 |
| JP | 2009-029039 | A | 2/2009 |
| JP | 2009-166370 | A | 7/2009 |
| JP | 2011-148127 | A | 8/2011 |
| JP | 2013-180450 | A | 9/2013 |

* cited by examiner

*Primary Examiner* — Jannelle M Lebron

(74) *Attorney, Agent, or Firm* — Harness, Dickey & Pierce, P.L.C.

(57) ABSTRACT

A recording device and control method execute a printhead retraction operation at an appropriate speed when a paper jam occurs, make removing jammed paper easy, and prevent problems from pieces of paper left inside the recording device. The printer 1 retracts the head carriage 59 to the home position HP or away position AP when a paper jam occurs. The retraction distance is calculated, and a retraction speed determined based on a speed control table 100. If the retraction speed is low, there is little chance of pulling on the jammed paper P and making removal of the jammed paper P difficult. If the retraction distance is long, changing retraction speed to a high speed during the retraction operation shortens time of the retraction operation. Therefore, there is little chance of the user tearing the jammed paper P, and little chance of problems caused by pieces of paper left inside.

14 Claims, 12 Drawing Sheets

100

| RETRACTION DISTANCE | SPEED CHANGE | SPEED CHANGE POSITION | SPEED AFTER CHANGE |
|---|---|---|---|
| 0 ~499 | NO | — | — |
| 500 ~999 | YES | 200 FROM CURRENT POSITION | FIRST HIGH RETRACTION SPEED V2 |
| 1000 ~1500 | YES | 200 FROM CURRENT POSITION | SECOND HIGH RETRACTION SPEED V3 |

* SPEED AFTER STARTING RETRACTION = INITIAL RETRACTION SPEED V1

101

| RETRACTION DISTANCE | HIGH SPEED DRIVE DISTANCE |
|---|---|
| 0 ～299 | 0 |
| 300 ～599 | 100 |
| 600 ～899 | 400 |
| 900 ～1199 | 700 |
| 1200 ～1500 | 1000 |

* SPEED AFTER STARTING RETRACTION = INITIAL RETRACTION SPEED V1
* SPEED FOR HIGH SPEED DRIVE = HIGH RETRACTION SPEED V4

FIG. 11

RECORDING DEVICE AND CONTROL METHOD THEREFOR

BACKGROUND

1. Technical Field

The present invention relates to a recording device that holds and conveys recording paper or other medium with a pair of conveyance rollers and records on the medium being conveyed with a recording head, and moves the recording head between a position opposing the medium and a position retracted from opposing the medium, and to a control method of the recording device.

2. Related Art

Recording devices such as inkjet printers have a conveyance mechanism comprising a conveyance roller pair that holds and conveys recording paper (media) between a driven roller and a conveyance roller, which is the drive roller, and a recording head that prints (records) by ejecting ink onto the recording paper being conveyed. Such recording devices may move a carriage that carries the recording head in a direction crosswise to the conveyance direction of the recording paper, and move the recording head between a position (recording position) opposing the recording paper on the conveyance path and a position (retraction position) removed to the side (widthwise) away from the conveyance path. When not printing, the recording head is moved to the retraction position where it waits.

Such recording devices may also have a cover disposed to the outside case of the recording device, and when a paper jam occurs with the conveyed recording paper stuck in the conveyance path, the cover can be opened to expose the conveyance path and remove the jammed recording paper. An example of such a recording device (image forming device) is described in JP-A-2013-180450. The image forming device described in JP-A-2013-180450 has an openable access cover disposed to the front of the device cabinet. This image forming device detects when the user opens the cover, and then retracts the recording head at a constant speed to a position removed from the conveyance path to open the conveyance path of the recording paper (medium). Because one roller of the conveyance roller pair is disposed to the cover, the recording paper is also released from being nipped by the conveyance roller pair as a result of the cover opening. The recording paper can therefore be easily removed from the conveyance path.

If the recording head is retracted from the conveyance path to open the conveyance path as described in JP-A-2013-180450, there is a chance of the moving recording head or carriage catching and pulling the recording paper stuck in the conveyance path, thereby making the paper jam worse, possibly damaging the paper, and making completely removing the jammed paper more difficult. When retracting the recording head from the conveyance path when a paper jam occurs, The carriage is therefore controlled to move at a slower speed than when printing.

However, the time required to completely retract the recording head obviously increases if the distance the carriage must travel is great when the carriage is retracted at a slow speed. Therefore, if the user opens the cover before head retraction operation is completed in order to quickly remove the paper jam and resume operation, the user may pull the jammed recording paper while the recording head is still positioned over the recording paper, and the recording paper may catch on the recording head or carriage and be torn. Pieces of the torn recording paper may then be inadvertently left inside the recording device and create other problems.

Considering that the risk of the recording paper being torn by the user is great when the retraction distance of the recording head is long and the retraction operation will take a relatively long time, the recording head is preferably retracted within an appropriate time when a paper jam occurs in order to prevent problems resulting from torn pieces of paper being left inside. However, the literature is silent about a carriage retraction operation for retracting the recording head within an appropriate time.

SUMMARY

A recording device and a control method therefor according to the invention enable retracting the recording head within an appropriate time while minimizing the chance of the paper jam being made worse by the retraction operation of the recording head when a paper jam occurs, and thereby reduce the chance of further problems being caused by pieces of paper being left inside the recording device.

A recording device according to one aspect of the invention has a conveyance roller pair that conveys a recording medium; a recording head that records on the recording medium; a carriage that carries the recording head; a carriage drive mechanism that moves the carriage crosswise to the conveyance direction of the recording medium; and a control unit that, when a paper jam of the recording medium is detected, controls a retraction operation to retract the carriage from over the recording medium. The control unit includes a retraction distance detection unit that acquires the retraction distance to a target retraction position based on detection of a paper jam; and a retraction speed control unit that sets the speed of carriage movement in the retraction operation based on the retraction distance.

Another aspect of the invention is a control method of a recording device that executes a retraction operation of moving a carriage that carries a recording head that records on the recording medium crosswise to the conveyance direction of the recording medium, and retracting the carriage from over the recording medium, when a paper jam of the recording medium conveyed by a conveyance roller pair is detected, the control method including: a first step of acquiring a retraction distance the carriage must be moved to a target retraction position based on detection of the paper jam; a second step of determining the speed of carriage movement in the retraction operation based on the retraction distance acquired in the first step; and a third step of moving the carriage to the target retraction position based on the carriage speed determined in the second step.

The recording device and control method of the invention thus execute a retraction operation that moves the carriage carrying the recording head to a position removed from the recording medium when a paper jam occurs, and makes removing the jammed paper easy. In the retraction operation, the recording device calculates the retraction distance to the target retraction position, and determines the speed of carriage movement (retraction speed) based on the retraction distance. By setting a high retraction speed when the retraction distance is long, the carriage and recording head can be retracted within an appropriate time. As a result, there is little chance of a user that wants to quickly resume device operation and opens a cover without waiting for the retraction operation to end pulling on the stuck paper and the paper tearing. There is therefore also little chance of torn pieces of paper being left inside the printer, and little chance of problems caused by such pieces of paper. Furthermore, because the carriage moves at a slow speed when the retraction distance is short, there is little chance of the moving head carriage and recording head pulling the recording medium in the direction of travel and worsening the paper jam.

Further preferably in the recording device and control method of the invention, the carriage speed when the retraction operation starts is set to a predetermined initial retraction speed, and whether or not to change the carriage speed during the retraction operation to a higher speed than the initial retraction speed is determined based on the retraction distance.

By thus starting the retraction operation at a slow speed and then changing to a higher speed as needed, there is little chance of the recording medium being pulled in the direction of carriage travel when the retraction operation starts. There is therefore little chance of making the paper jam worse, and little risk of damaging the recording medium.

Further preferably, the position where the speed changes is a position where there is little chance of the recording medium being damaged by the carriage and the recording head moving toward the target retraction position.

By thus changing the speed to shorten the retraction time, the risk of making the paper jam worse and damaging the recording medium can be reduced.

Further preferably in the recording device and control method of the invention, a speed control table is stored containing settings for the retraction distance including at least whether or not to change the speed, the position where the speed changes, and the speed after the speed changes, the speed of carriage movement in the retraction operation is determined based on the speed control table.

Thus comprised, a retraction speed appropriate to the retraction distance can be predefined, and the appropriate retraction operation can be selected from among the previously defined retraction operations. The recording head can therefore be retracted within an appropriate time by a simple control method.

For example, when the retraction distance is in a predefined first range, the speed does not change. When the retraction distance is in a second range that is longer than the first range, the speed of carriage movement can be set to change to a first high retraction speed that is greater than the initial retraction speed. This content can be stored in a speed control table.

Thus comprised, when the retraction distance is long, the time required to complete the retraction operation can be controlled to within a desirable time. When the retraction distance is short, the retraction operation can proceed at a slow speed and avoid making a paper jam worse.

When the retraction distance is in a third range with a retraction distance longer than the second range, the carriage speed may be set to change to a second high retraction speed that is greater than the first high retraction speed.

Control content can thus be stored in a speed control table. The retraction speed for retracting the carriage at a high speed can therefore be set in multiple levels appropriate to the length of the retraction distance. Retracting the carriage and recording head can therefore be completed in approximately the same time regardless of the length of the retraction distance.

Further alternatively, the speed may change when the retraction distance is greater than or equal to ½ the range of carriage movement, and the retraction speed may not change when the retraction distance is less than ½ the range of carriage movement.

Thus comprised, the carriage can be completely retracted within an appropriate time by means of a simple control method.

Further alternatively, the carriage speed when starting the retraction operation is set to a predetermined initial retraction speed, and the high speed drive distance at which the carriage is moved at a higher speed than the initial retraction speed is determined based on the retraction distance.

Thus comprised, retracting the carriage and recording head can be completed in approximately the same time regardless of the length of the retraction distance.

Further preferably in the recording device and control method of the invention, the conveyance roller pair is opened after the recording head reaches a position removed from the recording medium.

Thus comprised, the recording medium can be prevented from rising before the recording head is completely retracted from the recording medium and catching on the recording head. Furthermore, because the conveyance roller pair opens after the recording head is completely retracted, the jammed recording medium can be easily removed.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 11 shows an example of a speed control table in a first variation of the foregoing embodiment of the invention.

DESCRIPTION OF EMBODIMENTS

Preferred embodiments of the present invention are described below with reference to the accompanying figures. The following embodiments of the invention are applied to a printer with an inkjet head. The invention can also be applied to other types of recording devices having an inkjet head. The invention can also be applied to recording devices having a recording head other than an inkjet head.

General Configuration

Figure 1A:
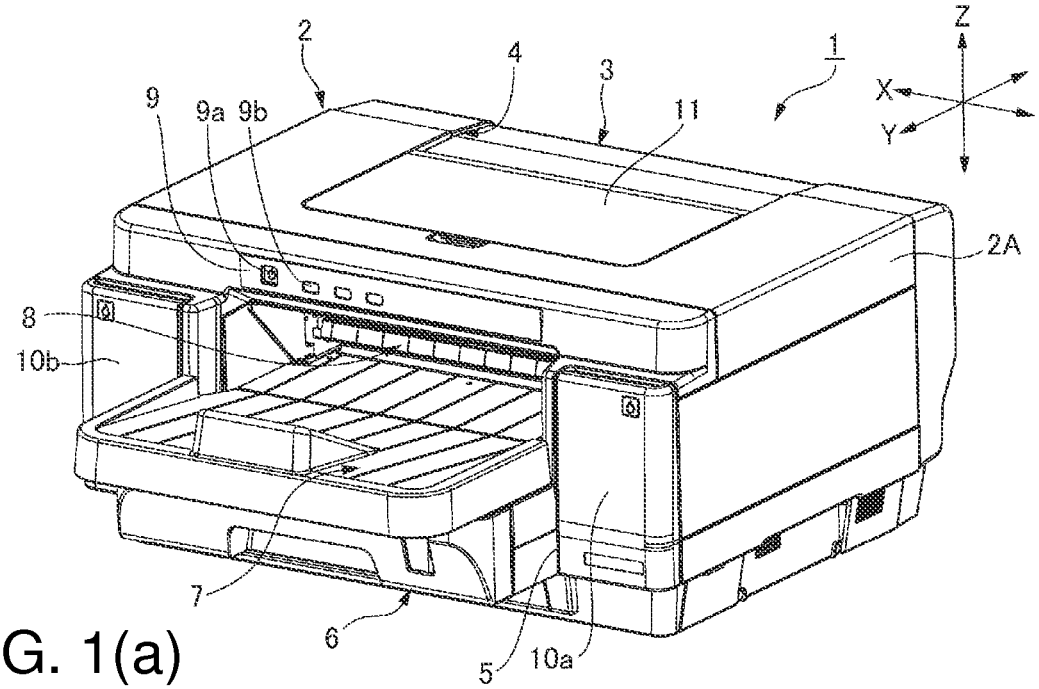
FIGS. 1(*a*) and 1(*b*) are oblique views of a printer according to the invention.
Figure 1B:
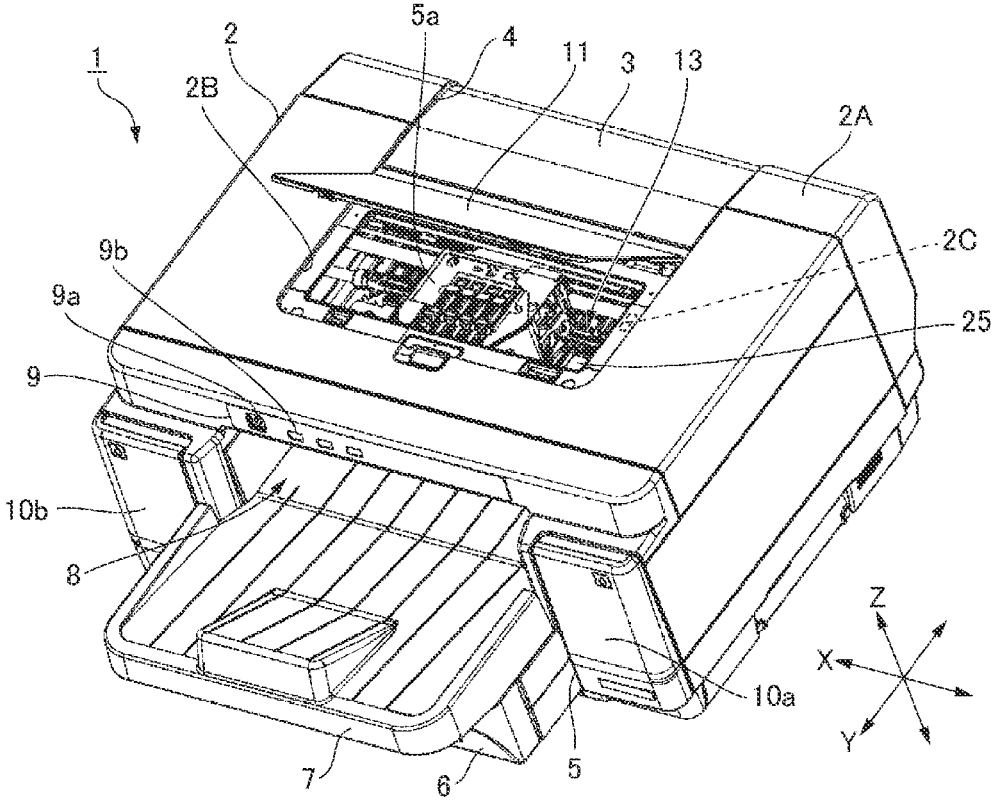
Figure 2:
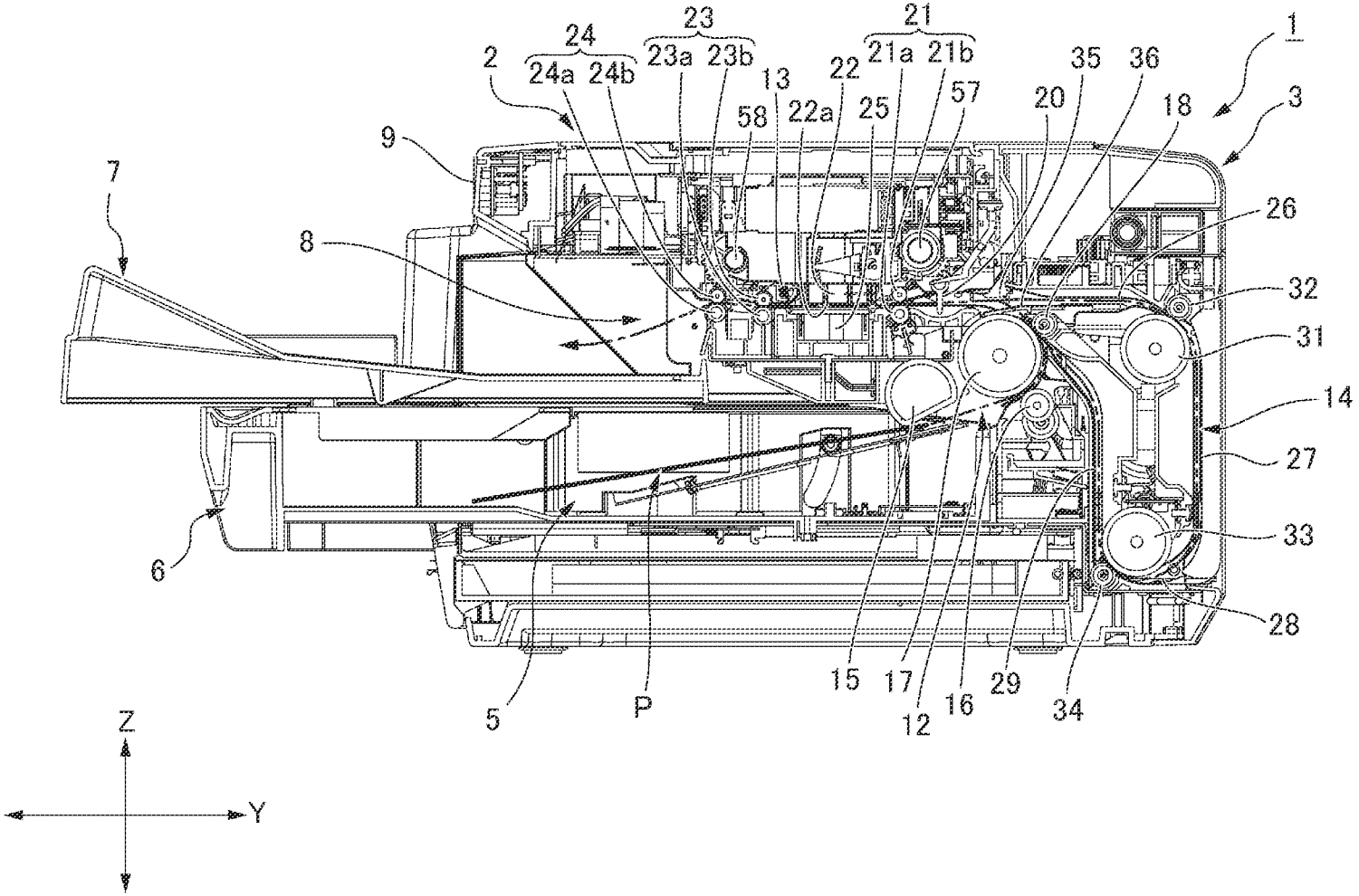
FIG. 2 is a vertical section view of the printer.

FIG. 1 is an external oblique view from the front of an inkjet printer ("printer" below) according to a preferred embodiment of the invention, FIG. 1(*a*) showing the printer with the access cover closed, and FIG. 1(*b*) showing the printer with the access cover open. FIG. 2 is a vertical section view of the internal configuration of the printer.

In the accompanying figures, the direction across the width of the printer is referred to as the transverse axis X, the direction between the front and back of the printer is the longitudinal axis Y, and the direction perpendicular to the transverse axis X and longitudinal axis Y is the vertical axis Z. Note that the X, Y, and Z axes are mutually perpendicular.

As shown in FIG. 1 and FIG. 2, the printer 1 has a printer cabinet 2 and a reversing unit 3. The printer cabinet 2 includes a main case 2A with a basically rectangular box-like shape that is long on the transverse axis X. A recess 4 is formed in the middle of the back of the printer cabinet 2, and the reversing unit 3 is installed in this recess 4.

The reversing unit 3 is a unit for reversing the front and back sides of the printing paper P ("paper" below), which is a sheet recording medium, and then returning the reversed paper into the printer cabinet 2. The reversing unit 3 can pivot on the end at the bottom of the printer on the vertical axis Z to open to the back of the printer on the longitudinal axis Y.

A paper cassette loading unit 5 is disposed to the front of the printer cabinet 2, and a paper cassette 6 can be removably installed from the front into the paper cassette loading unit 5. A paper discharge tray 7 is disposed above the paper cassette loading unit 5. A paper exit 8 is formed above the paper discharge tray 7.

An operating panel 9 is disposed the front of the printer above the paper exit 8, and includes a power switch 9*a* and a plurality of state indicators 9*b*.

Rectangular access doors 10*a*, 10*b* are attached to the front of the printer on opposite sides of the paper discharge tray 7 and paper exit 8. Opening the access doors 10*a*, 10*b* opens an ink cartridge loading unit (not shown in the figure) opens and ink cartridges (not shown in the figure) can be installed or replaced.

An access cover 11 for maintenance is attached to the top of the printer cabinet 2 in the middle. A support rod is disposed to one end of the access cover 11, and the access cover 11 pivots on this rod to open and close an opening 2B formed in the main case 2A. When the access cover 11 opens, the media conveyance path inside the printer (referred to below as the device-side conveyance path 13) is exposed as shown in FIG. 1(*b*). The paper P is printed on by the printhead 22 as it passes below the opening 2B, and is discharged from the paper exit 8.

A cover detector 2C that detects opening and closing of the access cover 11 is also disposed to the printer cabinet 2. The cover detector 2C is a contact sensor disposed to an edge of the opening 2B in this example. A different type of sensor can obviously be used as the cover detector 2C. For example, a sensor that detects the rotational position of the access cover 11 may be disposed to the support rod of the access cover 11.

Media Conveyance Path and Conveyance Mechanism

As shown in FIG. 2, a paper supply path 12, device-side conveyance path 13, and reversing conveyance path 14 are formed inside the printer 1. The paper supply path 12 and device-side conveyance path 13 are formed inside the printer cabinet 2, and the reversing conveyance path 14 is formed inside the reversing unit 3.

The paper supply path 12 is disposed between the paper cassette 6 and the device-side conveyance path 13 on the path through which the paper P is conveyed. Paper P stored in a stack in the paper cassette 6 is supplied through the paper supply path 12 to the device-side conveyance path 13.

The paper supply path 12 extends diagonally up from the back end of the paper cassette loading unit 5 on the longitudinal axis Y, curves toward the front, and connects to the device-side conveyance path 13. Paper P stored in the paper cassette 6 is fed by a paper feed roller 15 to the paper supply path 12. The supplied paper is fed one sheet at a time through the nipping part of a conveyance roller 17 and a retard roller 16, and is conveyed through the nipping part of the conveyance roller 17 and a follower roller 18 to the device-side conveyance path 13.

The device-side conveyance path 13 is the part of the conveyance path between the paper supply path 12 and the paper exit 8 extending substantially horizontally on the longitudinal axis Y. Disposed along the device-side conveyance path 13 in order from the upstream side in the direction the paper P is conveyed are the detection lever of a paper detector 20, a paper feed roller pair 21, a printhead 22, a first discharge roller pair 23, and a second discharge roller pair 24. The printhead 22 is an inkjet head and has a nozzle face 22*a* in which the ink nozzles are formed.

A platen 25 is disposed opposite the nozzle face 22*a* with a specific gap therebetween. When the paper P passes the detection position of the detection lever, the detection lever moves and the paper detector 20 detects passage of the paper P.

The paper feed roller pair 21 includes a paper feed roller 21*a* and a driven roller 21*b*. Paper fed from the paper supply path 12 to the device-side conveyance path 13 is conveyed by the conveyance roller 17 toward the paper feed roller pair 21. At this time, the paper P pushes the detection lever of the paper detector 20 up. The paper P then passes through the nipping position of the paper feed roller 21*a* and driven roller 21*b* of the paper feed roller pair 21, and is supplied to the printing position between the printhead 22 and platen 25. A friction layer of dispersed inorganic particles is formed on the surface of the paper feed roller 21*a*.

The first discharge roller pair 23 includes a first discharge roller 23*a* and a driven roller 23*b*, and the second discharge roller pair 24 includes a second discharge roller 24*a* and a driven roller 24*b*. After the paper passes the printing position, the paper is conveyed between the first discharge roller 23*a* and driven roller 23*b* and between the second discharge roller 24*a* and driven roller 24*b*, and is discharged from the paper exit 8 onto the paper discharge tray 7.

The paper feed roller pair 21, the first discharge roller pair 23, and the second discharge roller pair 24 can be switched between a nipping position holding the paper P between the rollers, and a release position with the rollers separated from each other. The release operation of the three sets of roller pairs is coordinated with the platen gap adjustment operation of the platen gap adjustment mechanism 70 described below.

Figure 3A:
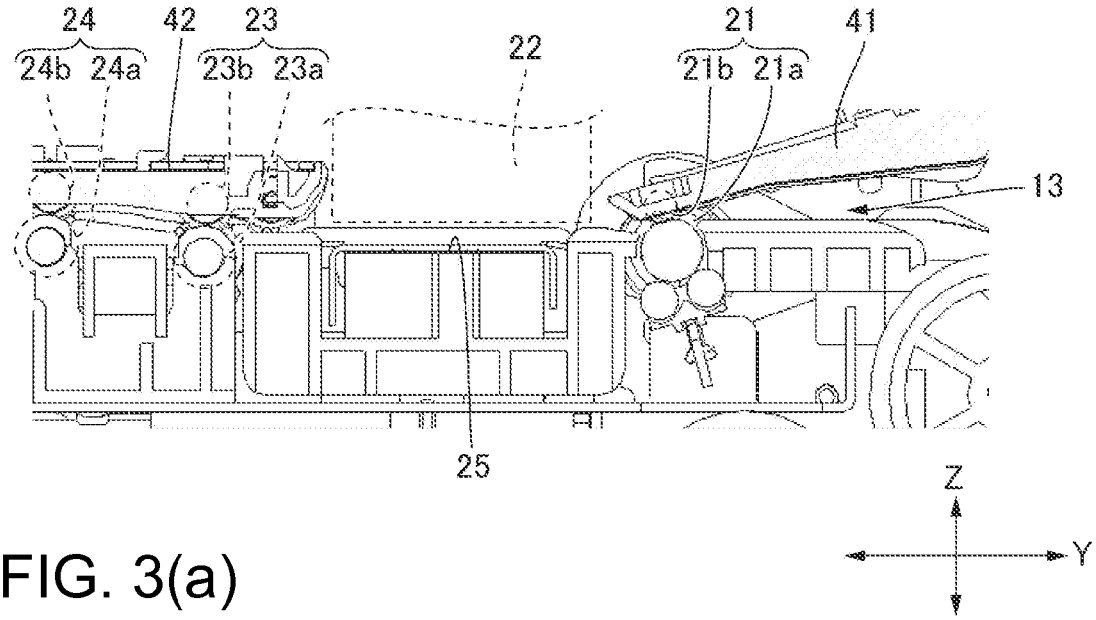
FIGS. 3(*a*) and 3(*b*) are enlarged views of part of the device-side conveyance path.
Figure 3B:
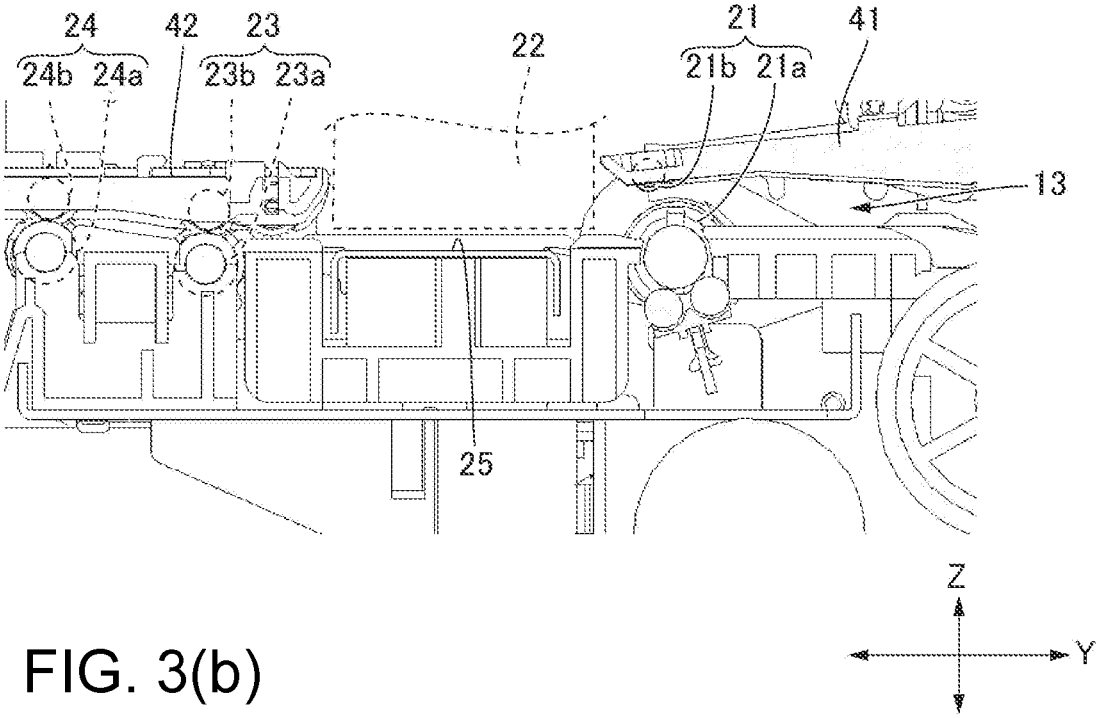

FIG. 3 is an enlarged view of part of the device-side conveyance path 13, FIG. 3(*a*) showing the paper feed roller pair 21 in the nipping position, and FIG. 3(*b*) showing the paper feed roller pair 21 in the release position.

The driven roller 21*b* of the paper feed roller pair 21 is located on the upstream side of the printhead 22 (the side toward the back of the printer) in the conveyance direction of the paper P at the front end of a first roller frame 41.

The first roller frame 41 is disposed above the device-side conveyance path 13 and is supported to pivot on the vertical axis Z. The first roller frame 41 is urged by an urging member not shown in the direction pushing the driven roller 21*b* to the paper feed roller 21*a*. The first roller frame 41, as described further below, tilts in the direction moving the driven roller 21*b* away from the paper feed roller 21*a* in conjunction with the platen gap adjustment operation. As a result, the paper feed roller pair 21 goes to the release position shown in FIG. 3(*b*).

The driven rollers 23*b*, 24*b* of the first and second discharge roller pairs 23, 24 are mounted on the downstream side of the printhead 22 (the side toward the front of the printer) in the conveyance direction of the paper P on a second roller frame 42. The second roller frame 42 is supported to move on the vertical axis Z, and is urged by an urging member not shown in the direction (towards the bottom of the printer) pushing the driven roller 23*b* to the first discharge roller 23*a*, and pushing the driven roller 24*b* to the second discharge roller 24*a*. As described further below, the second roller frame 42 moves the driven rollers 23*b*, 24*b* in the direction away from the first and second discharge rollers 23*a*, 24*a* (towards the top of the printer) in conjunction with the platen gap adjustment operation.

The reversing conveyance path 14 formed inside the reversing unit 3 is located below the device-side conveyance path 13 on the vertical axis Z, and is a conveyance path that generally forms a loop. The reversing conveyance path 14 includes an upstream path 26 that connects to the upstream end (the end at the back side of the printer) of the device-side conveyance path 13 and extends substantially horizontally to the back on the longitudinal axis Y, a descending path 27 that curves and extends down in a straight line on the vertical axis Z from the upstream path 26, a bottom path 28 that connects to the descending path 27 and curves to the front on the longitudinal axis Y, and an ascending path 29 that curves and extends upward from the bottom path 28.

The top part of the ascending path 29 curves at an angle to the printer front, and merges with the paper supply path 12 in the middle. The ascending path 29 and the downstream part of the paper supply path 12 therefore share a common path. This common path is a curved path extending along the outside of the conveyance roller 17.

A first conveyance roller 31 and a follower roller 32 are disposed between the upstream path 26 and the descending path 27, and a second conveyance roller 33 and a follower roller 34 are disposed between the bottom path 28 and the ascending path 29. Paper conveyed from the device-side conveyance path 13 to the reversing conveyance path 14 is first nipped by the first conveyance roller 31 and follower roller 32. The paper P is then conveyed by the first conveyance roller 31 to the nipping part of the second conveyance roller 33 and follower roller 34. The paper P is then conveyed by the second conveyance roller 33 to the nipping part of the conveyance roller 17 and follower roller 18. The paper is then fed by the conveyance roller 17 to the device-side conveyance path 13 again.

A path-changing flapper 36 is disposed at the junction 35 of the upstream end of the device-side conveyance path 13, the upstream end of the reversing conveyance path 14, and the downstream end of the paper supply path 12. When paper P is reversed from the device-side conveyance path 13 side, the paper P is guided by the path-changing flapper 36 to the reversing conveyance path 14. When the paper has passed through the reversing conveyance path 14 and returns to the junction 35, the front and back of the paper P are reversed from when the paper P entered the reversing conveyance path 14. Because the paper P returned to the junction 35 from the reversing conveyance path 14 pushes the path-changing flapper 36 up, the downstream end of the reversing conveyance path 14 communicates with the device-side conveyance path 13, and the paper P is fed into the device-side conveyance path 13. Because the reversing conveyance path 14 forms a loop, the paper P is returned from the reversing conveyance path 14 to the device-side conveyance path 13 with the front and back of the paper P reversed. Duplex printing on the paper P is thus possible by passing the paper P through the reversing conveyance path 14.

Print Mechanism Unit

Figure 4:
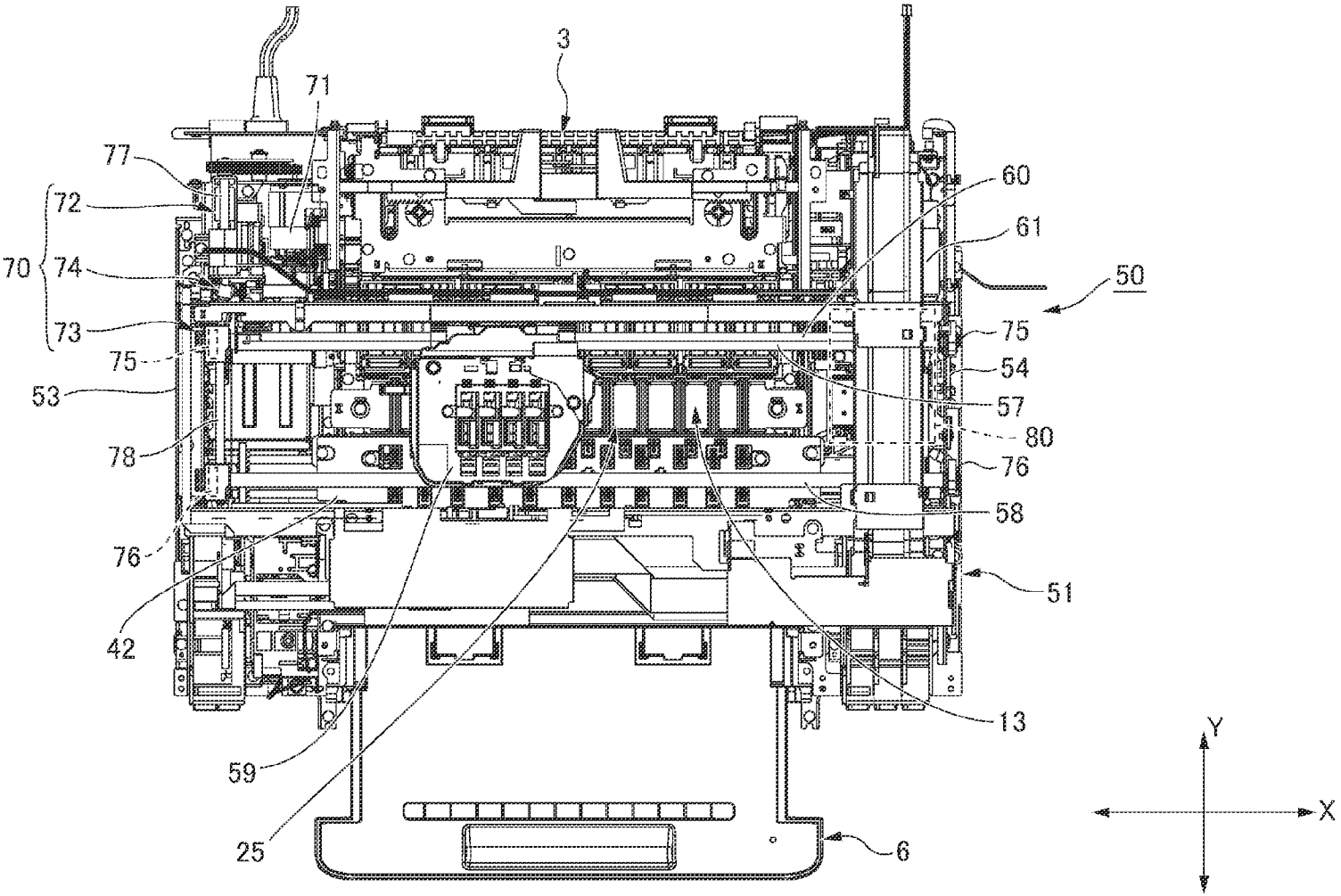
FIG. 4 is a plan view of the print mechanism.
Figure 5:
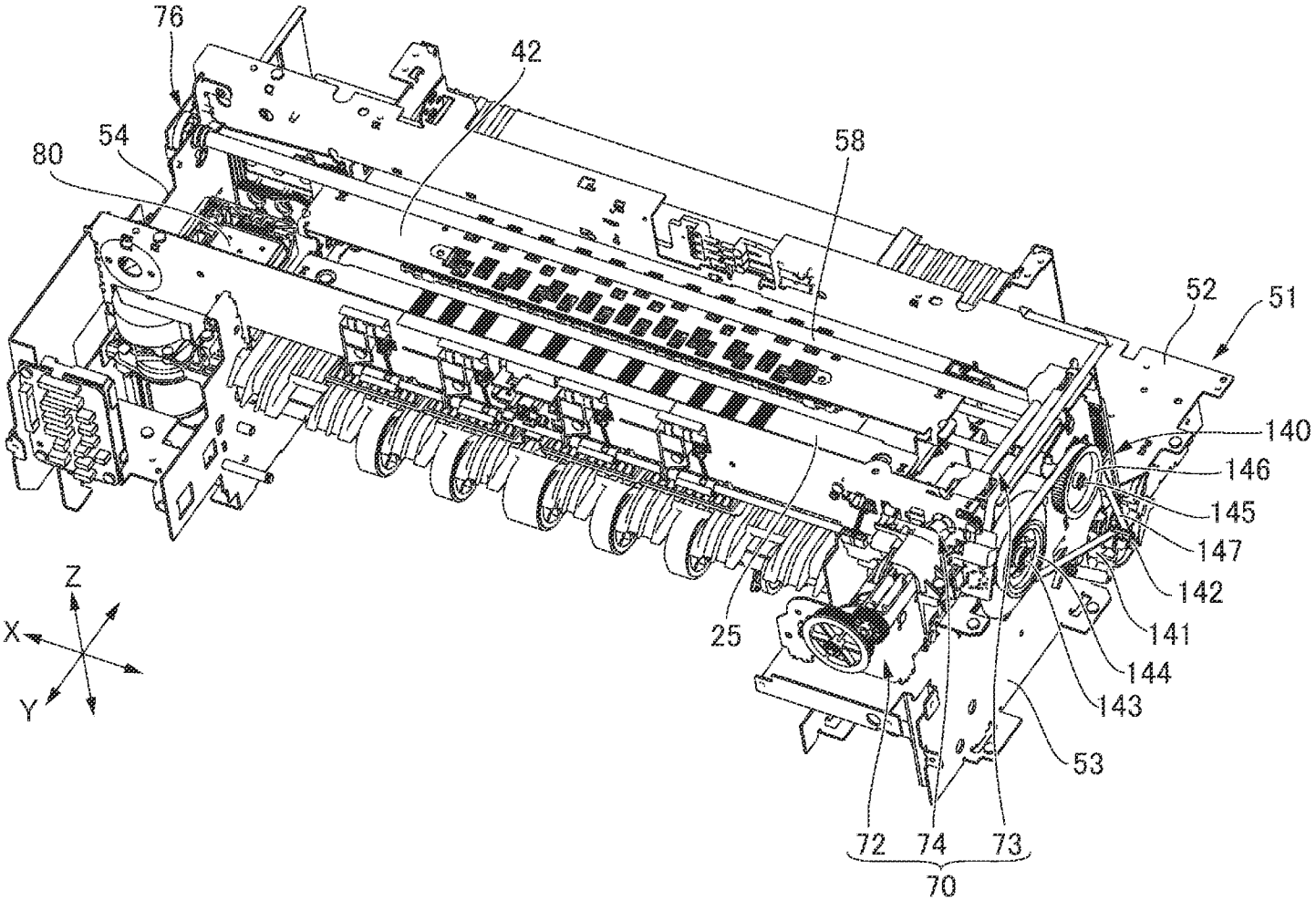
FIG. 5 is an oblique view from the back showing a main part of the print mechanism.

FIG. 4 is a plan view of the print mechanism unit that is housed inside the main case 2A of the printer 1, and shows the print mechanism unit with the main case 2A and paper discharge tray 7 removed. FIG. 5 is an oblique view of the main part of the print mechanism unit 50 from the back of the printer on the longitudinal axis Y.

The print mechanism unit 50 includes a sheet metal print unit frame 51, and the components of the print mechanism unit 50 are assembled on the print unit frame 51. The print unit frame 51 includes a base frame 52 (FIG. 5) at the bottom of the print mechanism unit 50, and side frames 53, 54 rising perpendicularly from the base frame 52 at positions on opposite sides on the transverse axis X.

Two carriage guide rails 57, 58 extend parallel to the transverse axis X between the side frames 53, 54. A head carriage 59 is mounted on the carriage guide rails 57, 58. The head carriage 59 can move on the transverse axis X along the carriage guide rails 57, 58. The head carriage 59 is connected to a timing belt 60 extending on the transverse axis X at a position near the guide rail 57 that is closer to the back of the printer. The timing belt 60 is mounted on a pair of pulleys, and is driven by a carriage drive motor 61 through the pulleys.

The timing belt 60, pair of pulleys, and the carriage drive motor 61 embody the carriage drive mechanism that moves the head carriage 59 reciprocally on the transverse axis X.

The printhead 22 is mounted on the head carriage 59. The printhead 22 is an inkjet head, and is disposed with the nozzle face 22*a* (FIG. 2) in which the ink nozzles are formed facing the bottom of the printer. A platen 25 is disposed below the printhead 22.

The paper P is conveyed along the longitudinal axis Y over the surface of the platen 25. The printhead 22 moves on the transverse axis X along the carriage guide rails 57, 58, and is positioned above the paper P conveyed over the surface of the platen 25. The printhead 22 prints by ejecting ink onto the paper P from the ink nozzles formed in the nozzle face 22*a*.

As shown in FIG. 5, the power transfer mechanism 140 of the conveyance roller pairs (paper feed roller pair 21 and first discharge roller pair 23) that convey the paper P through the device-side conveyance path 13 is assembled on the side frame 53 on the outside side on the transverse axis X.

A paper feed motor 141 is mounted on the base frame 52 side of the side frame 53. The ends 143, 145 of the roller shafts of the paper feed roller 21*a*, which is the drive roller of the paper feed roller pair 21, and the first discharge roller 23*a*, which is the drive roller of the first discharge roller pair 23, are supported freely rotatably by the side frame 53. The ends 143, 145 protrude from the side frame 53 to the outside on the transverse axis X, and transfer gears 144, 146 are affixed coaxially to the ends 143, 145. Rotation from the paper feed motor 141 is transferred to the paper feed roller 21*a* and first discharge roller 23*a* through the timing belt 147 mounted on the transfer gears 144, 146 and a pinion 142 affixed to the distal end of the paper feed motor 141 shaft.

A platen gap adjustment mechanism 70 for adjusting the gap (platen gap) between the printhead 22 and platen 25 is disposed to the side frame 53 on the inside on the transverse axis X. The platen gap is the distance from the nozzle face 22*a* of the printhead 22 to the surface of the platen 25, or the distance from the nozzle face 22*a* to the printing surface of the paper P conveyed over the platen 25. The platen gap adjustment mechanism 70 moves the two carriage guide rails 57, 58 located above the platen 25 on the vertical axis Z, and thereby moves the printhead 22 carried on the head carriage 59 on the vertical axis Z and increases or decreases the platen gap.

The platen gap adjustment mechanism 70 includes a stationary-side unit 72 to which a gap adjustment motor 71 and other stationary-side components mounted on the print unit frame 51 side are disposed; a movable-side unit 73 to which movable-side components that can move on the vertical axis Z in unison with the carriage guide rails 57, 58 are disposed; a universal joint unit 74 that transfers torque from the stationary-side unit 72 to the movable-side unit 73; and rotary cam mechanisms 75, 76.

The stationary-side unit 72 includes a stationary-side rotary shaft 77 that transfers torque from the gap adjustment motor 71 to the stationary-side universal joint part of the universal joint unit 74.

The movable-side unit 73 has a movable-side rotary shaft 78, which is a rotation transfer member for synchronously turning the two carriage guide rails 57, 58. The movable-side rotary shaft 78 is connected to the movable-side universal joint part of the universal joint unit 74. The stationary-side rotary shaft 77 and the movable-side rotary shaft 78 extend on the longitudinal axis Y.

A rotary cam mechanism 75 is disposed to each end of carriage guide rail 57, and a rotary cam mechanism 76 is disposed to each end of carriage guide rail 58. The rotary cam mechanism 75 is a conversion mechanism that converts rotation of the carriage guide rail 57 to movement of the carriage guide rail 57 on the vertical axis Z (in the gap adjustment direction). Rotary cam mechanism 58 is likewise a conversion mechanism that converts rotation of the carriage guide rail 58 to movement of the carriage guide rail 58 on the vertical axis Z (in the gap adjustment direction).

When the carriage guide rails 57, 58 turn synchronously, the rotary cam mechanisms 75, 76 turn in the same phase of rotation. As a result, the movable-side unit 73 and the carriage guide rails 57, 58 move synchronously on the vertical axis Z while maintaining the same posture. As a result, the printhead 22 on the movable side moves on the vertical axis Z relative to the platen 25 on the stationary side while maintaining the same posture, and the platen gap is adjusted.

As described above, the printer 1 has a mechanism that opens (releases) the conveyance roller pair that conveys the paper P through the device-side conveyance path 13 and releases the paper in conjunction with the platen gap adjustment operation of the platen gap adjustment mechanism 70. The platen gap adjustment mechanism 70 is a mechanism that tilts the first roller frame 41 and opens (releases) the paper feed roller pair 21 based on rotation of the carriage guide rail 57. The platen gap adjustment mechanism 70 is also a mechanism that moves the second roller frame 42 up and opens (releases) the first and second discharge roller pairs 23, 24 based on rotation of the carriage guide rail 58.

Carriage Operation

Figure 6A:
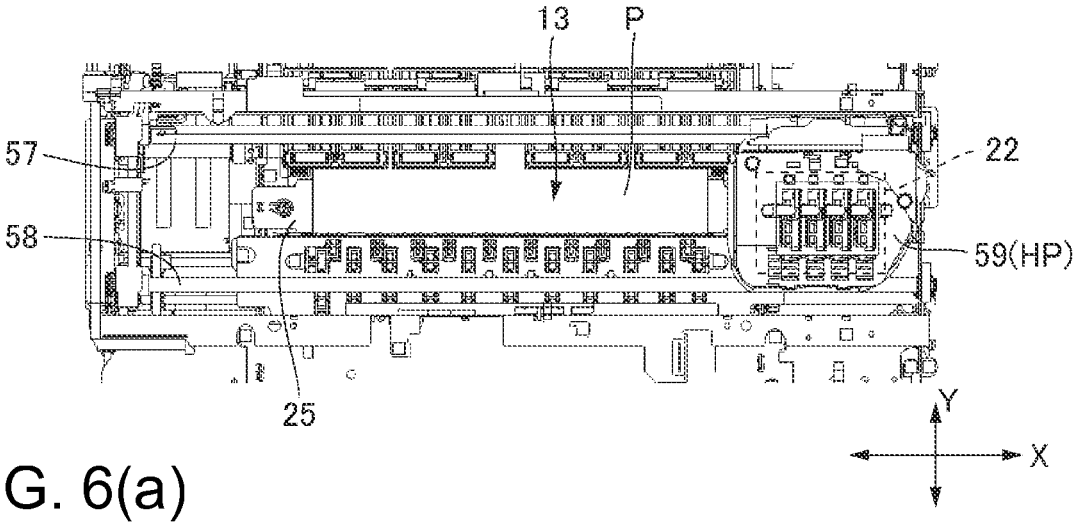
FIGS. 6(*a*), 6(*b*) and 6(*c*) illustrate the range of head carriage and printhead movement.
Figure 6B:
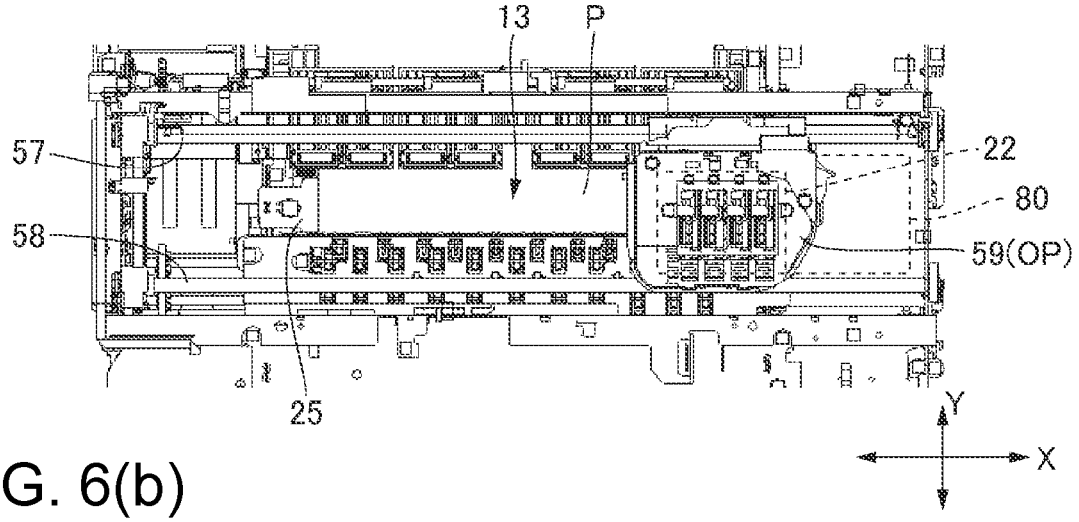
Figure 6C:
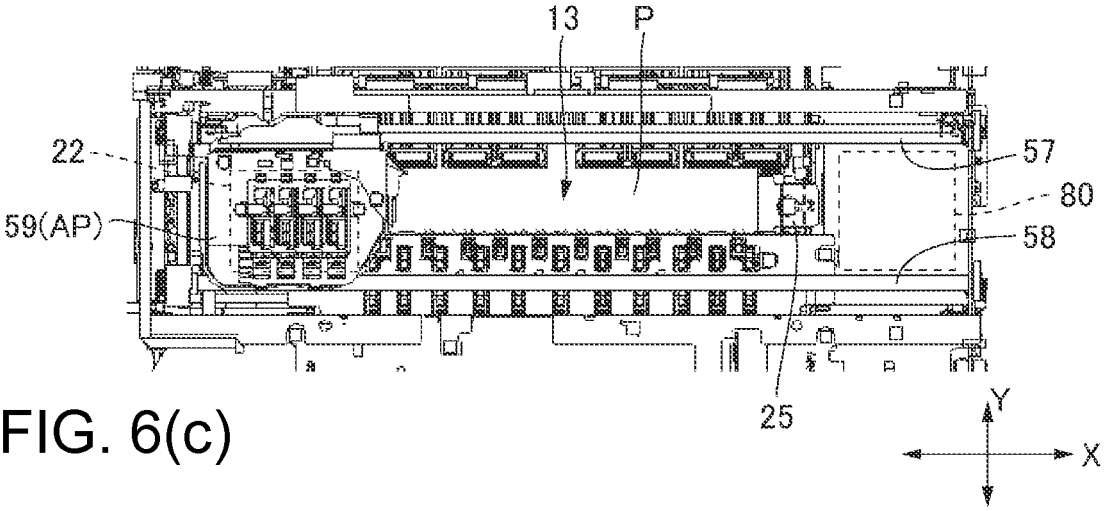

FIG. 6 illustrates the range of movement of the head carriage 59 and printhead 22. FIG. 6(*a*) shows the home position HP at one end of the movement range; FIG. 6(*b*) shows the home-side retraction position OP, which is a position to which the printhead 22 moves away from the paper P on the home position HP side; and FIG. 6(*c*) shows the away position AP, which is a position at the other end of the movement range.

The head carriage 59 carrying the printhead 22 moves bidirectionally by means of the carriage drive mechanism described above in a direction (on the transverse axis X) perpendicular to the conveyance direction (the longitudinal axis Y) of the paper P through the device-side conveyance path 13. The range of movement of the printhead 22 and head carriage 59 is the range from the home position HP between the platen 25 and the one side frame 54 and the away position AP (second retraction position) between the platen 25 and the other side frame 53.

The home position HP is the standby position where the printhead 22 waits when not printing. A maintenance unit 80 is disposed at the bottom of the printer at the home position HP. The maintenance unit 80 includes a head cap that opposes the nozzle face 22*a* when the printhead 22 is at the home position HP, a lift mechanism that moves the head cap up and down, and a suction pump that suctions ink from inside the head cap. The maintenance unit 80 raises the head cap and caps the nozzle face 22*a* when the printhead 22 is at the home position HP. Maintenance such as suctioning ink from the ink nozzles is performed when the nozzle face 22*a* is capped by the head cap.

As shown in FIG. 6(*a*), the paper P conveyed through the device-side conveyance path 13 travels over the middle of the platen 25 on the transverse axis X. When the printhead 22 moves from over the paper P to the h printer, the printhead 22 passes through the home-side retraction position OP shown in FIG. 6(*b*) to the home position HP. The home-side retraction position OP is the position immediately after the printhead 22 is completely removed from over the paper P. The home position HP is further to the outside from the home-side retraction position OP on the transverse axis X.

At the home position HP, the head carriage 59 is completely removed from over the paper P.

The away position AP shown in FIG. 6(*c*) is a position on the opposite side of the paper P as the home-side retraction position OP where the printhead 22 is completely removed from over the paper P.

Control System

Figures 7, 8:
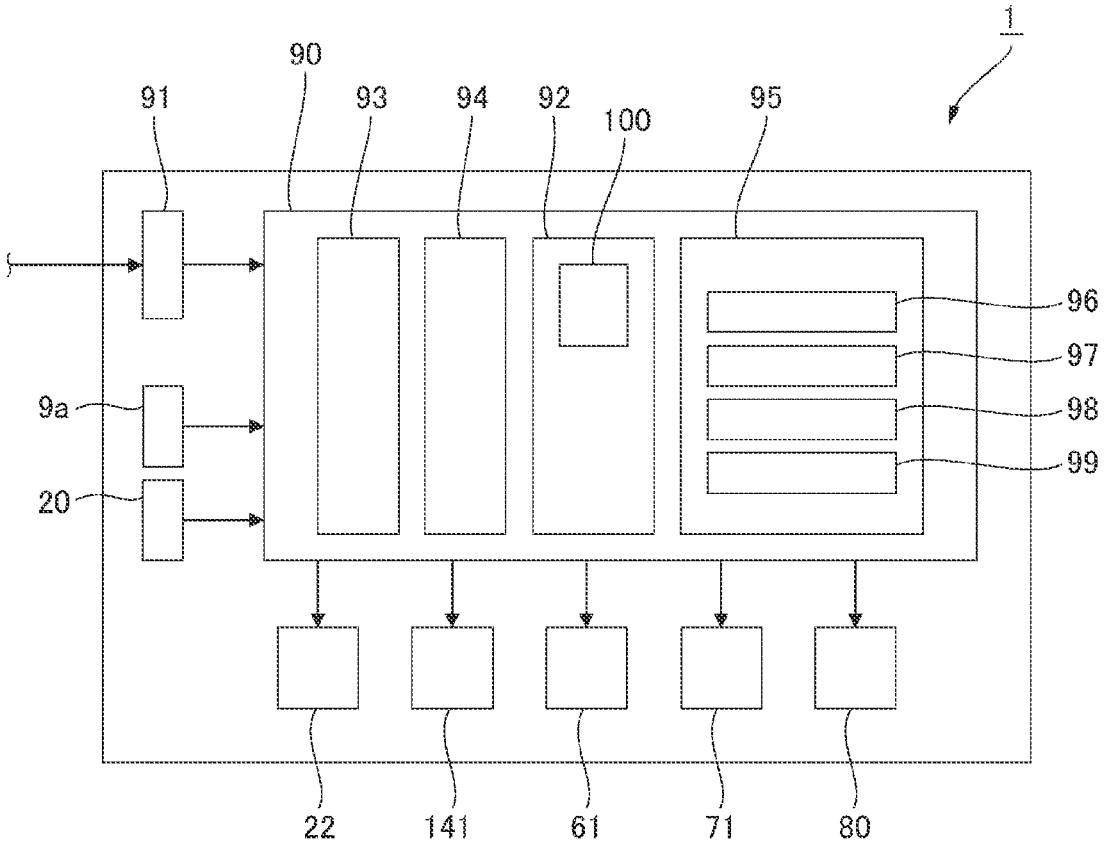
FIG. 7 is a block diagram of the control system of the printer.
FIG. 8 shows an example of a speed control table.

FIG. 7 is a block diagram of the control system of the printer 1. Signals from operating means such as the power switch 9*a* disposed to the operating panel 9 are input to the control unit 90 of the printer 1. Signals from sensors (such as the paper detector 20) disposed inside the printer are also input to the control unit 90. An input/output (I/O) unit 91 is also connected to the control unit 90, and print data sent from a host computer or other host device is received through the I/O unit 91.

A drive source (such as the paper feed motor 141 that is the drive source of the paper feed roller pair 21) that drives the conveyance mechanism of rollers and such that conveys the paper P through the paper supply path 12, device-side conveyance path 13, and reversing conveyance path 14 is connected to the output side of the control unit 90. The printhead 22 and carriage drive motor 61 are also connected to the output side of the control unit 90. The drive sources of the maintenance unit 80 (such as the motor that moves the head cap up and down, and the suction pump that suctions the inside the of the head cap) are also connected to the output side of the control unit 90. The gap adjustment motor 71 of the platen gap adjustment mechanism 70 is also connected to the output side of the control unit 90.

The control unit 90 includes the storage unit 92, a drive control unit 93, a maintenance control unit 94, and a paper jam processing unit 95.

The storage unit 92 stores data and programs used for controlling the printer 1. The drive control unit 93 drives the paper feed roller pair 21 and such based on the print data to convey the paper P.

The drive control unit 93 drives the carriage drive mechanism synchronized to the conveyance operation to position the printhead 22 to the paper P, and drives the printhead 22 to eject ink and print on the paper P.

The maintenance control unit 94 executes the maintenance operation timed to the printhead 22 returning to the home position HP. More specifically, the maintenance control unit 94 performs maintenance operations such as capping the nozzle face 22*a* with the head cap, suctioning the ink nozzles, and flushing to eject ink into the head cap.

When a paper jam occurs in the printer, the paper jam processing unit 95 applies control enabling easily removing the jammed paper P. The paper jam processing unit 95 includes a paper jam detection unit 96, a retraction distance detection unit 97, a retraction speed control unit 98, and a retraction operation execution unit 99. These functional units are embodied by commands contained in a control program stored in the storage unit 92 being executed by a CPU or other control element.

The paper jam detection unit 96 detects if a paper jam has occurred based on such factors as the output of sensors that detect the paper P, and the drive load of the motor that drives the conveyance roller pair that conveys the paper P, which change when a paper jam occurs in the printer. For example, if paper P conveyed through the device-side conveyance path 13 jams, the paper jam can be detected based on the drive load of the paper feed motor 141 or the output of the paper detector 20. A paper jam can also be detected based on the drive load of the carriage drive motor 61.

The retraction distance detection unit 97 acquires the direction the head carriage 59 was moving when the paper jam occurred, and the current position of the head carriage 59, and determines the direction in which the head carriage 59 should be retracted (the retraction direction) and the target retraction position based on the acquired direction of travel and current position. The retraction distance detection unit 97 then calculates the retraction distance, which is the distance the head carriage 59 must travel from the current position, which is the location of the head carriage 59 when the paper jam occurred, to the target retraction position.

The target retraction position is either the home position HP or the away position AP, both of which are locations where the printhead 22 is removed from over the paper P.

The method the retraction distance detection unit 97 uses to determine the target retraction position and the retraction direction may be a method that sets whichever of the home position HP and the away position AP is closest to the current position as the target retraction position, and sets the direction of travel from the current position to the selected target retraction position as the retraction direction.

Alternatively, the retraction distance detection unit 97 may use a method that sets the current direction of travel as the retraction direction, and sets whichever of the home position HP and the away position AP is located on the side in the selected retraction direction as the target retraction position.

Other decision methods may also be used. For example, the target retraction position may be decided based on the operation that executes after operation resumes. Further alternatively, the home position HP may always be set as the target retraction position so that the printhead is always retracted to the home position HP when a paper jam occurs.

The retraction speed control unit 98 determines the content of the head carriage 59 retraction operation when moving from the current position to the target retraction position based on the calculated retraction distance. More specifically, the retraction speed control unit 98 sets the speed of head carriage 59 movement immediately after the retraction operation starts to a predetermined initial retraction speed V1. The retraction speed control unit 98 then determines whether or not to change the retraction speed during the retraction operation based on a predefined speed control table 100. The content of the retraction operation (such as whether or not to change the speed, where (when) to change the speed, and the retraction speed after the speed is changed) is stored relationally to the retraction distance in the speed control table 100. The initial retraction speed V1 and speed control table 100 are stored in the storage unit 92.

FIG. 8 shows an example of a speed control table 100.

As shown in FIG. 8, the retraction distance is divided into three ranges in the speed control table 100. The retraction distance is 0-499 in the first range, 500-999 in the second range, and 1000-1500 in the third range.

The speed control table 100 also stores whether or not to change the speed in each of the three ranges. If the change speed parameter of a particular retraction distance (range) is set to Yes, the position of the speed change and the retraction speed after the speed change are set for that retraction distance.

In this example, the change speed parameter of the first range is set to No. The change speed parameter of the second and third ranges is set to Yes, and the position for changing the speed is set to 200. The retraction speed after the speed changes is set to a first high retraction speed V2 in the second range, and is set to a second high retraction speed V3 in the third range. Because the retraction distance is longer in the third range than the second range, a second high retraction speed V3 that is faster than the first high retraction speed V2 is set for the third range.

The printer 1 in this example is a serial head printer having a printhead 22 that is smaller than the width of the paper P and prints to the full width of the paper P by moving the printhead 22 bidirectionally on the transverse axis X. The control unit 90 of the printer 1 moves the head carriage 59 at a predetermined reference speed V0 when printing. The initial retraction speed V1 applied when the retraction operation of the head carriage 59 starts after a paper jam occurs is slower than the reference speed V0.

The initial retraction speed V1 is the speed at which the head carriage 59 moves when the head carriage 59 and printhead 22 start moving after a paper jam occurs. This initial retraction speed V1 is a speed at which there is a low probability of the head carriage 59 and printhead 22 pulling and tearing the paper P, or causing the paper P to jam further so that the carriage drive motor 61 is overloaded and stops.

The initial retraction speed V1 is 5 ips (inch/second) in this example. The first high retraction speed V2 in this example is 40 ips, that is, eight times the initial retraction speed V1. The second high retraction speed V3 is a higher speed than the first high retraction speed V2. The first high retraction speed V2 and second high retraction speed V3 can be set to a speed that can control the time required for the retraction operation to a desired time (such as 5 s or less in this example). Note that the speeds described above are for example only, and different speeds may obviously be used.

The position for changing the retraction speed when the retraction distance is long and the retraction speed changes to a high speed is set to a position where there is a low risk of the paper P being pulled and damaged by the head carriage 59 and printhead 22. This position is, for example, a position moved a specific distance (200 or more in this example) away from the location when the paper jam occurred (the current position). We have confirmed that if the head carriage 59 moves at a high speed immediately after the retraction operation starts, the chance of catching and pulling the paper P and thereby worsening the paper jam and damaging the paper P is high, but the likelihood of damaging the paper is low even if the head carriage 59 is moved at a high speed after moving a distance of approximately 200 or more in the retraction direction.

Figure 9A:
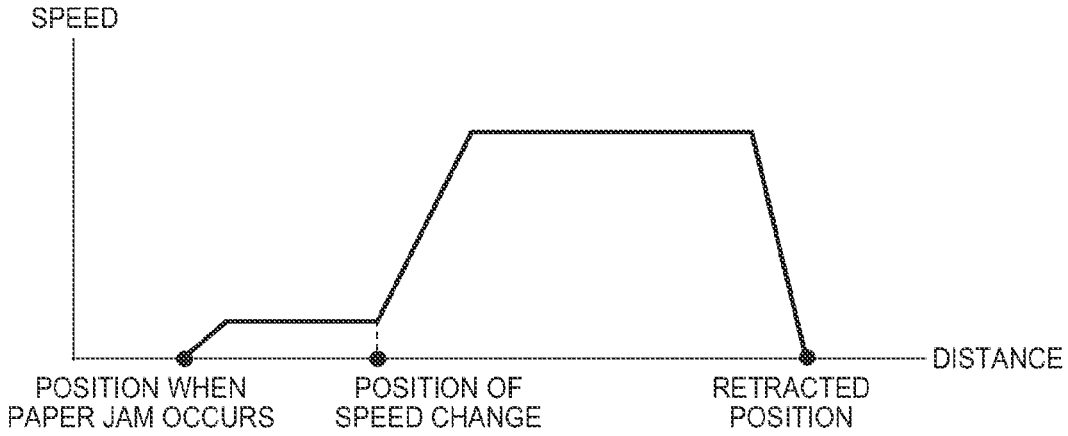
FIGS. 9(*a*), 9(*b*) and 9(*c*) describe an example of a speed profile used for speed control of the head carriage.
Figure 9B:
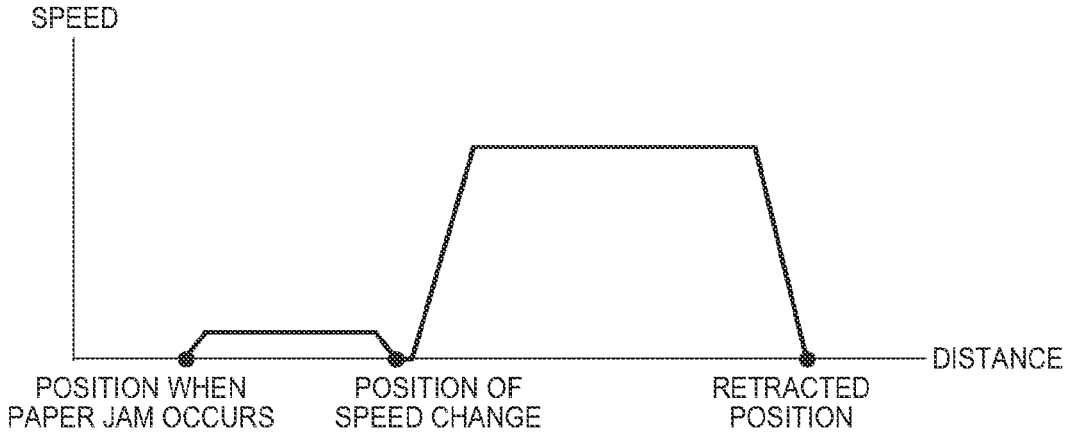
Figure 9C:
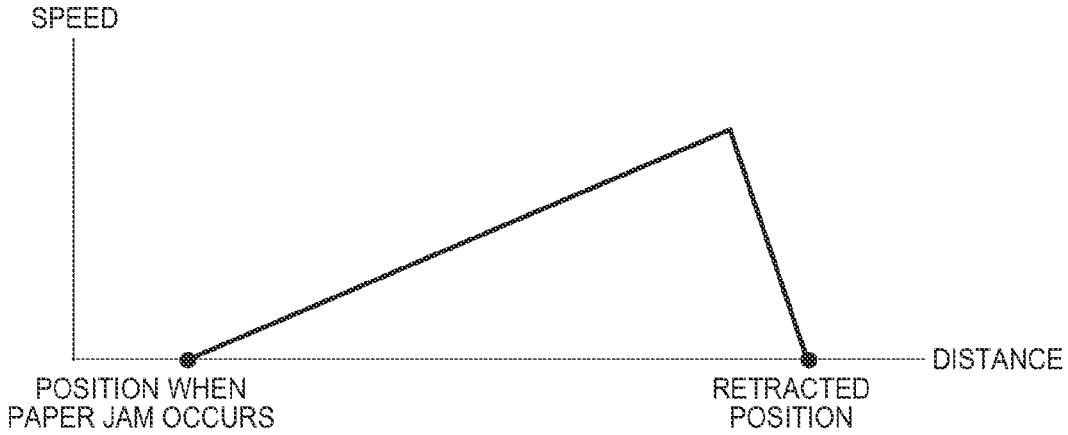

FIG. 9 shows an example of a speed profile used for speed control of the head carriage 59. FIG. 9(*a*) shows a speed profile used to change the speed without stopping the head carriage 59. FIG. 9(*b*) shows a speed profile that pauses the head carriage 59 to change the speed. The retraction speed can also be controlled using a speed profile such as shown in FIG. 9(*c*).

The speed profile in FIG. 9(*c*) is a speed profile that increases the retraction speed at a constant acceleration rate from when the retraction operation starts, and then decreases the retraction speed at a constant acceleration rate to stop at the retraction position.

These control profiles are stored in a storage unit 92. To retract the head carriage 59, the required speed profile is read from the storage unit 92, and driving the carriage drive motor 61 is controlled by PID control based on the speed profile.

Control when a Paper Jam Occurs

Figure 10:
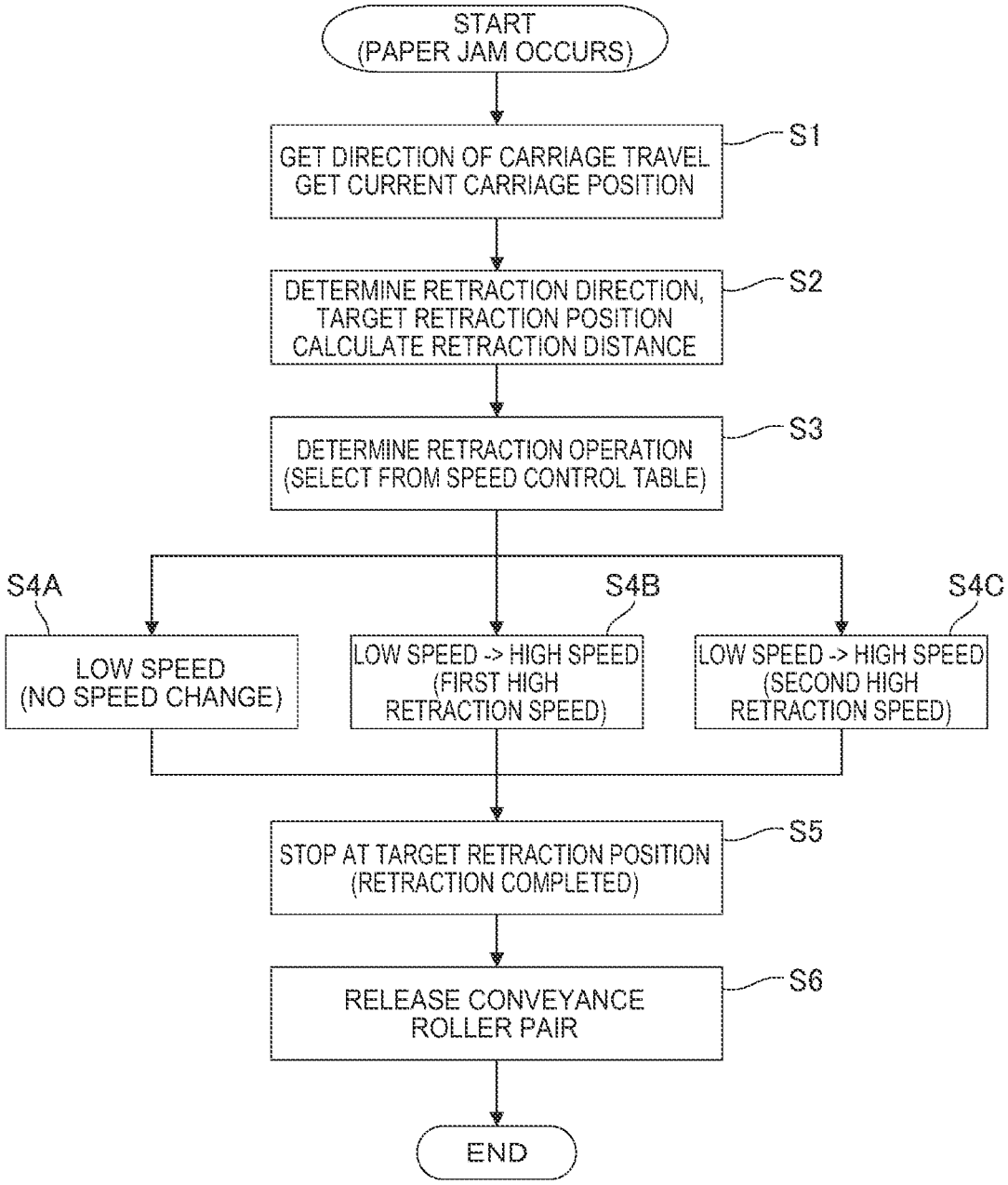
FIG. 10 is a flow chart of printer control when a paper jam occurs.

FIG. 10 is a flow chart describing control when a paper jam occurs. As described above, when a paper jam occurs in the printer, the control unit 90 of the printer 1 applies control that reduces the likelihood of worsening the paper jam or damaging the paper P while enabling easily removing the stuck paper P. As a result, the paper jam processing unit 95 starts the control process shown in FIG. 10 when the paper jam detection unit 96 detects that a paper jam occurred in the device-side conveyance path 13 during while printing or during conveyance of the paper P.

In step S1, the retraction distance detection unit 97 first gets the direction of head carriage 59 travel and the current position of the head carriage 59. Based on the direction of travel and current position acquired in step S1, the retraction distance detection unit 97 determines the direction (retraction direction) in which to move the head carriage 59 and the target retraction position in step S2. The retraction distance detection unit 97 also calculates the retraction distance, that is, the distance the head carriage 59 will travel from the current position to the target retraction position. For example, if the current position is closer to the home position HP than the away position AP, the target retraction position is set to the home position HP and the direction to the home position HP is set as the retraction direction. The distance from the current position to the home position HP (the retraction direction) is also calculated. Note that the direction of travel acquired in step S1 may be set as the retraction direction. For example, if the current direction of travel is the direction to the home position HP, that direction is set to the retraction direction, and the target retraction position is set to the home position HP.

The retraction speed control unit 98 then determines the content of the retraction operation in step S3. More specifically, the head carriage 59 moves at a specific low speed (initial retraction speed V1) when the retraction operation starts even if the retraction distance is long.

Based on the retraction distance calculated in step S2, the retraction speed control unit 98 references the speed control table 100 stored in the storage unit 92 and determines whether or not there is a speed change. If a speed change is set for that retraction distance, the retraction speed control unit 98 sets the position for changing the speed and the new retraction speed after the speed changes. As described above, the retraction distance is divided into three ranges in the speed control table 100. The retraction speed control unit 98 determines whether the retraction distance calculated in step S2 is in the first range, second range, or third range. The retraction operation corresponding to the appropriate range is then selected.

Control then goes to the step (step S4A, S4B, or S4C) in which the retraction operation execution unit 99 executes the retraction operation of the selected content.

Step S4A is executed when the retraction distance is in the first range (0-499). Because the retraction distance is short in this case, the head carriage 59 is moved at the low speed (initial retraction speed V1) to the target retraction position without the speed changing.

Step S4B is executed when the retraction distance is in the second range (500-999). Because the retraction distance is relatively long in this case, the speed changes during the retraction operation. More specifically, the head carriage 59 is moved a specific distance (200) from the current position at a low speed (initial retraction speed V1), the speed of travel is then changed to the first high retraction speed V2, and the head carriage 59 is moved at the first high retraction speed V2 to the target retraction position.

Step S4C is executed when the retraction distance is in the third range (1000-1500). Because the retraction distance is even longer in this case, the speed changes during the retraction operation. More specifically, the head carriage 59 is moved a specific distance (200) from the current position at a low speed (initial retraction speed V1), the speed of travel is then changed to the second high retraction speed V3, and the head carriage 59 is moved at the second high retraction speed V3 to the target retraction position.

After the retraction operation, the retraction operation execution unit 99 stops the head carriage 59 at the target retraction position (step S5). The conveyance roller pair is then opened (released) (step S6). The gap adjustment motor 71 of the platen gap adjustment mechanism 70 is driven in step S6. As a result, the first roller frame 41 and second roller frame 42 move synchronously in conjunction with the platen gap adjustment operation, and the paper feed roller pair 21, first discharge roller pair 23, and second discharge roller pair 24 release the paper P. As a result of the control process of step S1 to step S6, the head carriage 59 is retracted and the conveyance roller pair opens and releases the paper P, and paper P stuck in the device-side conveyance path 13 can be easily removed.

Note that if the home position HP is the target retraction position, the conveyance roller pair may be released when the carriage reaches the home-side retraction position OP before the home position HP.

Effect of the Invention

As described above, in the retraction operation that moves the head carriage 59 carrying the printhead 22 to a position removed from the paper P when a paper jam occurs, the printer 1 according to this embodiment calculates the retraction distance to the target retraction position before starting the retraction operation, and determines the content of the retraction operation based on the retraction distance.

More specifically, the head carriage 59 is moved at a slow initial retraction speed V1 initially, and if the retraction distance is short, continues moving at the initial retraction speed V1 to the target retraction position. As a result, if the retraction speed is a slow speed (initial retraction speed V1) at least when the retraction operation starts, there is little chance of the moving head carriage 59 and printhead 22 pulling the paper P in the direction of travel and worsening the paper jam. The paper P can also be easily removed and the risk of damaging the paper P is low.

If the retraction distance is long, the speed changes to a higher speed (first high retraction speed V2 or second high retraction speed V3) during the retraction operation, and the head carriage 59 is moved at the higher speed to the target retraction position. The time required for the retraction operation can therefore be shortened, and the head carriage 59 can be retracted within an appropriate time (such as within 5 seconds). As a result, there is little chance of a user that wants to quickly resume printer 1 operation, cannot wait for the retraction operation to end, and opens the access cover 11 pulling on the stuck paper P and the paper P tearing. There is therefore also little chance of torn pieces of paper being left inside the printer, and little chance of problems caused by such pieces of paper.

Variation 1

The content of the retraction operation executed when a paper jam occurs in the printer 1 may differ from the operation described above. The retraction distance is divided into three ranges (first range, second range, third range), and the speed of head carriage 59 movement in the second part of the retraction operation is adjusted in three levels (initial retraction speed V1, first high retraction speed V2, second high retraction speed V3).

In this variation of the foregoing embodiment, however, there are only two retraction speeds, a low speed (the initial retraction speed V1) and a high speed (high retraction speed V4), and the distance the head carriage 59 is moved at the high speed (high speed drive distance) is adjusted in multiple stages according to the retraction distance. Note that the high retraction speed V4 in this first variation may be the same as the first high retraction speed V2 or the second high retraction speed V3, or a different speed.

FIG. 11 shows an example of the speed control table 101 in this variation. The speed control table 101 shown in FIG. 11 defines five retraction distance ranges, and sets a different high speed drive distance for each range. More specifically, the retraction distance is divided into five ranges: 0-299 (first range), 300-599 (second range), 600-899 (third range), 900-1199 (fourth range), and 1200-1500 (fifth range). The high speed drive distance is also set in five levels: 0, 100, 400, 700, 1000.

Figure 12:
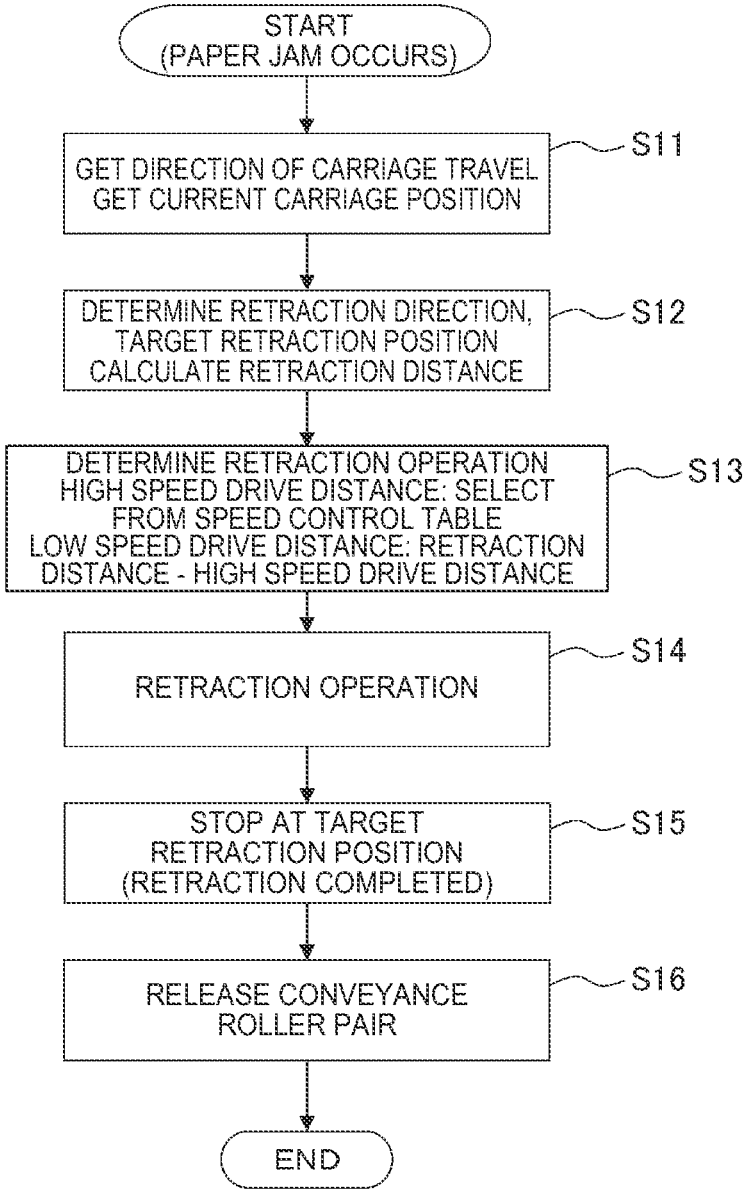
FIG. 12 is a flow chart of printer control when a paper jam occurs in the first variation of the foregoing embodiment of the invention.

FIG. 12 is a flow chart of control when a paper jam occurs in this first variation of the embodiment described above. As described above, the paper jam processing unit 95 starts this process when the paper jam detection unit 96 detects a paper jam occurred on the device-side conveyance path 13. Steps S11 and S12 are the same as steps S1 and S2 in FIG. 10. More specifically, the direction of travel and current position of the head carriage 59 are acquired in step S11, and in step S12 the direction to move (the retraction direction) the head carriage 59 and the target retraction position are determined, and the retraction distance is calculated.

In step S13, the retraction speed control unit 98 determines the content of the retraction operation. More specifically, the head carriage 59 moves at a specific low speed (initial retraction speed V1) when the retraction operation starts even if the retraction distance is long.

The retraction speed control unit 98 then determines which of the first to fifth ranges registered in the speed control table 101 covers the retraction distance calculated in step S12, and gets the high speed drive distance set for that range. The retraction speed control unit 98 also subtracts the selected high speed drive distance from the retraction distance calculated in step S12, and sets the low speed drive distance.

In step S14, the retraction operation execution unit 99 then executes the retraction operation of the content selected in step S13.

If the retraction distance is in the first range (0-299), the high speed drive distance is 0 and the retraction distance therefore equals the low speed drive distance. More specifically, the head carriage 59 moves at the low speed (initial retraction speed V1) to the target retraction position without the speed changing during the retraction operation.

If the retraction distance is in the second range (300-599), the head carriage 59 moves the low speed drive distance (retraction distance−100) at the low speed (initial retraction speed V1), and then moves the distance (100) to the target retraction position at the high speed (high retraction speed V4).

As when the retraction distance is in the second range, when the retraction distance is in the third range, fourth range, or fifth range, the head carriage 59 first moves the low speed drive distance (retraction distance−high speed drive distance) at the low speed (initial retraction speed V1), and then moves the distance (high speed drive distance) to the target retraction position at the high speed (high retraction speed V4).

After the retraction operation, the head carriage 59 is stopped at the target retraction position in step S15. The conveyance roller pair is then opened (released) (step S16). As a result, the head carriage 59 is retracted and the conveyance roller pair opens and releases the paper P, and paper P stuck in the device-side conveyance path 13 can be easily removed.

As described above, in this variation as in the embodiment described above, the head carriage 59 is moved to the target retraction position at the initial retraction speed V1 when the retraction distance is short. When the retraction distance is long, the speed of the head carriage 59 is changed during the retraction operation to a faster speed (high retraction speed V4), and the head carriage 59 then moves at this fast speed to the target retraction position. In addition, the distance (high speed drive distance) the head carriage 59 travels at high speed changes according to the length of the retraction distance, and when the retraction distance is long, the high speed drive distance increases. Therefore, as in the embodiment described above, because the head carriage 59 always moves at a slow speed when the retraction operation starts, there is little chance of making the paper jam worse and little risk of damaging the paper P.

Because the speed of the head carriage 59 changes to a high speed when the retraction distance is long, the time required for the retraction operation can be shortened, and the head carriage 59 can be retracted within an appropriate time (such as within 5 seconds). Furthermore, because the high speed drive distance changes according to the retraction distance, the carriage and recording head can be completely retracted in approximately the same time regardless of the length of the retraction distance. As a result, because there is little chance of a user that wants to quickly resume printer 1 operation pulling on the stuck paper P, there is also little chance of torn pieces of paper being left inside the printer, and little chance of problems caused by such pieces of paper.

Variation 2

As in the first variation described above, there are only two retraction speeds, a low speed (the initial retraction speed V1) and a high speed (high retraction speed V5), in this variation of the foregoing embodiment. Whether or not to change the retraction speed from low speed to high speed is also determined based on the retraction distance as described above, but the retraction distance used as the decision standard is ½ of the range of head carriage 59 movement (the distance from the away position AP to the home position HP).

Figure 13:
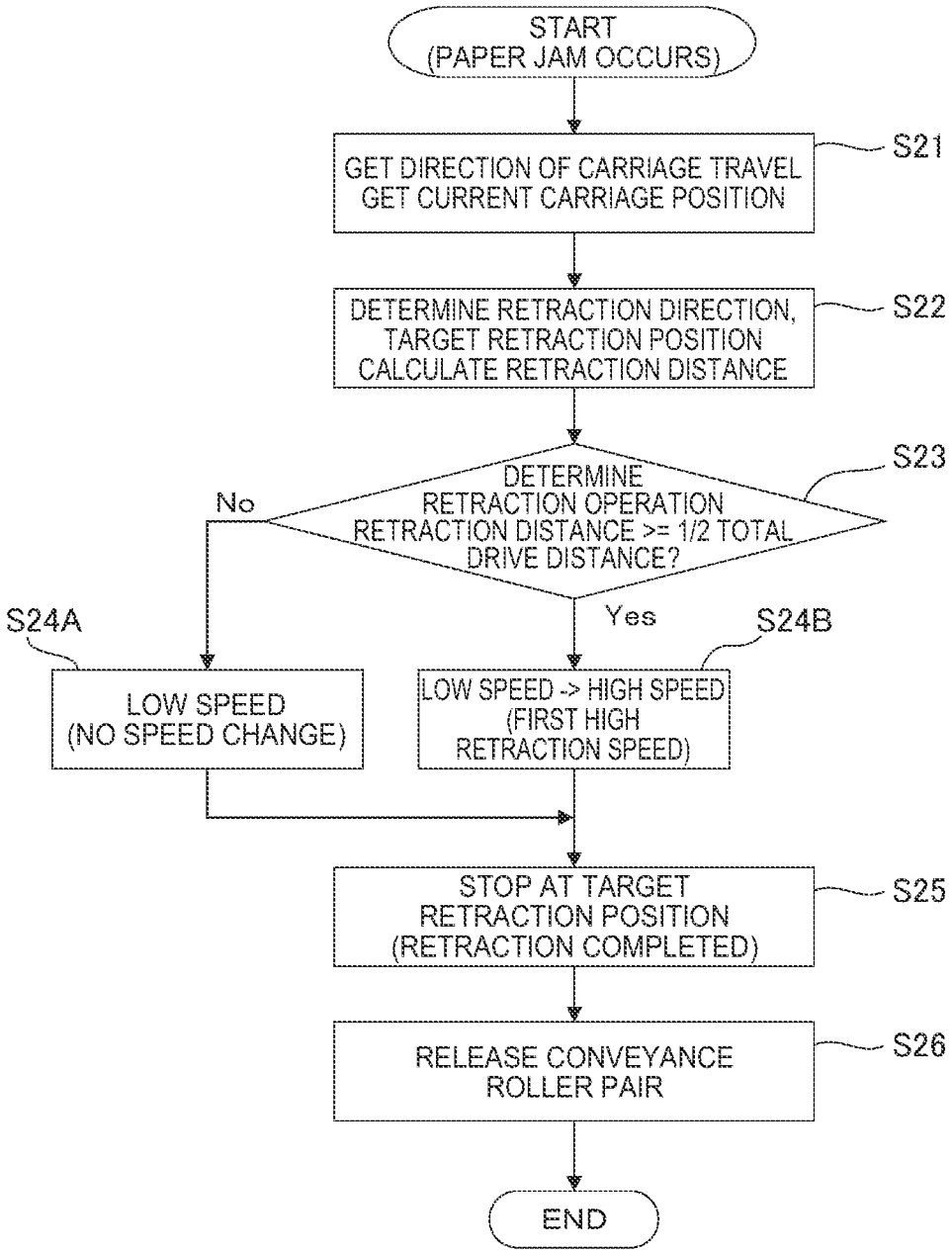
FIG. 13 is a flow chart of printer control when a paper jam occurs in a second variation of the foregoing embodiment of the invention.

FIG. 13 is a flow chart of control when a paper jam occurs in this second variation of the embodiment described above. As described above, the paper jam processing unit 95 starts the process shown in FIG. 13 when the paper jam detection unit 96 detects a paper jam occurred on the device-side conveyance path 13. As in step S1 in FIG. 10, the direction of travel and current position of the head carriage 59 are acquired in step S21. In step S22, the direction to move (the retraction direction) the head carriage 59 and the target retraction position are determined.

In step S23, the retraction speed control unit 98 determines the content of the retraction operation. More specifically, the retraction speed control unit 98 calculates the retraction distance as described above, and determines if the calculated retraction distance is greater than or equal to ½ the distance (total drive distance) from the away position AP to the home position HP. If the retraction distance is less than half the total drive distance, the retraction speed is not changed and control goes to step S24A. If the retraction distance is greater than or equal to half the total drive distance, the retraction speed changes and control goes to step S24B.

If control goes to step S24A, the retraction operation execution unit 99 moves the head carriage 59 at the low speed (initial retraction speed V1) to the target retraction position.

If control goes to step S24B, the retraction operation execution unit 99 moves the head carriage 59 a specific distance (200) from the current position at the low speed (initial retraction speed V1), and then changes the speed to the high retraction speed V5 and moves the head carriage 59 to the target retraction position at the high speed (high retraction speed V5).

After the retraction operation, the head carriage 59 is stopped at the target retraction position in step S25. The conveyance roller pair is then opened (released) (step S26). As a result, the head carriage 59 is retracted and the conveyance roller pair opens and releases the paper P, and paper P stuck in the device-side conveyance path 13 can be easily removed.

As described above, in this second variation as in the embodiments described above, the initial retraction speed V1 is maintained to the target retraction position when the retraction distance is short. When the retraction distance is long, the speed of the head carriage 59 is changed during the retraction operation to a faster speed (high retraction speed V5), and the head carriage 59 then moves at this fast speed to the target retraction position. Therefore, as in the embodiment described above, because the head carriage 59 always moves at a slow speed when the retraction operation starts, there is little chance of making the paper jam worse and little risk of damaging the paper P. The time required for the retraction operation can be shortened by a simple control process, and the head carriage 59 can be retracted within an appropriate time (such as within 5 seconds). As a result, because there is little chance of a user that wants to quickly resume printer 1 operation pulling on the stuck paper P, there is also little chance of torn pieces of paper being left inside the printer, and little chance of problems caused by such pieces of paper.

Note that the retraction operation may also be controlled by the process described above according to the open or closed state of the access cover 11. For example, the head carriage 59 may be retracted while monitoring the output of a cover detector 2C, and if the cover detector 2C detects the access cover 11 was opened, the retraction speed of the head carriage 59 may be changed from the initial retraction speed V1 to a faster speed.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A recording device comprising:

a conveyance roller pair configured to convey a recording medium;

a recording head configured to record on the recording medium;

a carriage configured to carry the recording head;

a carriage drive mechanism configured to move the carriage crosswise to the conveyance direction of the recording medium; and a control unit configured to, when a paper jam of the recording medium is detected, control a retraction operation to retract the carriage from over the recording medium, the control unit including a retraction distance detection unit that acquires a retraction distance to a target retraction position based on detection of a paper jam, and a retraction speed control unit that controls speed of retraction of the carriage, including setting an initial predetermined retraction speed of the carriage when the retraction operation starts, and if the retraction distance is longer than a predetermined distance, the retraction speed is changed from the initial predetermined retraction speed to a higher predetermined retraction speed during the retraction operation, wherein the control unit has a storage unit that stores a speed control table including at least retraction distances, and for each retraction distance, whether or not to change the retraction speed, a position where the retraction speed changes if it changes, and the retraction speed after the speed changes if it changes;

the retraction distances are non-overlapping ranges including a first range and a second range that covers longer distances than the first range;

a change speed setting in the first range indicates not to change the retraction speed; and a change speed setting in the second range indicates to change the retraction speed to a first high retraction speed.

2. The recording device described in claim 1, wherein:

the position where the speed changes is a position where there is little chance of the recording medium being damaged by the carriage and the recording head moving toward the target retraction position.

3. The recording device described in claim 1, wherein:

the retraction speed control unit determines the speed of carriage movement in the retraction operation based on the speed control table.

4. The recording device described in claim 1, wherein:

the non-overlapping ranges in the speed control table also include a third range that the retraction distance in the third range that covers longer distances than the second range; and a change speed setting in the third range indicates to change the retraction speed to a second high retraction speed that is greater than the first high retraction speed.

5. The recording device described in claim 1, wherein:

the retraction speed control unit changes the retraction speed when the retraction distance is greater than or equal to ½ a range of carriage movement, and does not change the retraction speed when the retraction distance is less than ½ the range of carriage movement.

6. The recording device described in claim 1, wherein:

the retraction speed control unit sets the retraction speed when starting the retraction operation to an initial retraction speed which is predetermined, and based on the retraction distance, determines a high speed drive distance at which the carriage is moved at a higher retraction speed than the initial retraction speed.

7. The recording device described in claim 1, wherein:

the control unit executes the retraction operation when a paper jam of the recording medium is detected, and then opens the conveyance roller pair.

8. A control method of a recording device that executes a retraction operation of moving a carriage configured to carry a recording head configured to record on a recording medium crosswise to the conveyance direction of the recording medium, and retracting the carriage from over the recording medium, when a paper jam of the recording medium conveyed by a conveyance roller pair is detected, the control method comprising:

a first step of acquiring a retraction distance the carriage must be moved to a target retraction position based on detection of the paper jam;

a second step of controlling speed of retraction of the carriage, including setting an initial predetermined retraction speed of the carriage when the retraction operation starts, and if the retraction distance is longer than a predetermined distance, the retraction speed is changed from the initial predetermined retraction speed to a higher predetermined retraction speed during the retraction operation; and a third step of moving the carriage to the target retraction position based on the speed determined in the second step, wherein the first step uses a stored speed control table including at least retraction distances, and for each retraction distance, whether or not to change the retraction speed, a position where the retraction speed changes if it changes, and the retraction speed after the speed changes if it changes;

the retraction distances are non-overlapping ranges including a first range and a second range that covers longer distances than the first range;

a change speed setting in the first range indicates not to change the retraction speed; and a change speed setting in the second range indicates to change the retraction speed to a first high retraction speed.

9. The control method of a recording device described in claim 8, wherein:

the second step sets the position where the speed changes to a position where there is little chance of the recording medium being damaged by the carriage and the recording head moving toward the target retraction position.

10. The control method of a recording device described in claim 8, wherein:

the second step sets the speed to change when the retraction distance is greater than or equal to ½ a range of carriage movement, and not change when the retraction distance is less than ½ the range of carriage movement.

11. The control method of a recording device described in claim 8, wherein:

the second step sets the retraction speed when starting the retraction operation to an initial retraction speed which is predetermined, and based on the retraction distance, determines a high speed drive distance at which the carriage is moved at a higher retraction speed than the initial retraction speed.

12. The control method of a recording device described in claim 8, wherein:

the conveyance roller pair is opened after the recording head reaches a position deviated from over the recording medium.

13. The control method of a recording device described in claim 8, wherein:

the second step determines to not change the carriage speed when the retraction distance is in the first range; and determines to change the carriage speed to the first high retraction speed that is greater than the initial retraction speed when the retraction distance is in the second range.

14. The control method of a recording device described in claim 13, wherein:

the second step determines to change the carriage speed to a second high retraction speed that is greater than the first high retraction speed when the retraction distance is in a third range, the retraction distance in the third range being longer than the retraction distance in the second range.

* * * * *